US009724698B2

(12) United States Patent
Cottam et al.

(10) Patent No.: US 9,724,698 B2
(45) Date of Patent: Aug. 8, 2017

(54) GRINDING MILL

(71) Applicants: Steven Cottam, Ivins, UT (US); Phillip Dietz, Saint George, UT (US)

(72) Inventors: Steven Cottam, Ivins, UT (US); Phillip Dietz, Saint George, UT (US)

( * ) Notice: Subject to any disclaimer, the term of this patent is extended or adjusted under 35 U.S.C. 154(b) by 449 days.

(21) Appl. No.: 14/478,075

(22) Filed: Sep. 5, 2014

(65) Prior Publication Data

US 2016/0067714 A1 Mar. 10, 2016

(51) Int. Cl.

| | |
|---|---|
| ***B02C 11/04*** | (2006.01) |
| ***B02C 7/08*** | (2006.01) |
| ***B02C 7/17*** | (2006.01) |
| ***B02C 7/18*** | (2006.01) |

(52) U.S. Cl.

CPC ..... *B02C 11/04* (2013.01); *B02C 7/08* (2013.01); *B02C 7/17* (2013.01); *B02C 7/184* (2013.01); *B02C 7/186* (2013.01)

(58) Field of Classification Search

CPC B02C 11/04; B02C 7/186; B02C 7/18; B02C 7/17; B02C 7/08

USPC ..... 241/100, 261.2, 261.3

See application file for complete search history.

(56) References Cited

U.S. PATENT DOCUMENTS

| | | | | |
|---|---|---|---|---|
| 1,465,666 | A * | 8/1923 | Grohens | A47J 19/00 222/129 |
| 4,037,797 | A * | 7/1977 | Stevens | B02C 7/11 241/100 |
| 4,057,194 | A | 11/1977 | Orton | |
| 2012/0294109 | A1 | 11/2012 | Boozer | |

FOREIGN PATENT DOCUMENTS

| | | | |
|---|---|---|---|
| DE | 102007058677 | A1 | 1/2009 |
| DE | 102010020866 | A1 | 8/2011 |

* cited by examiner

*Primary Examiner* — Mark Rosenbaum

(74) *Attorney, Agent, or Firm* — Zachary D. Renstrom

(57) ABSTRACT

An improved grinding mill that utilizes mill stones that minimizing the mechanical processes required to regulating the mill stones and allow an user to gain quick and easy access to the mill stones by removing a hopper. In addition, to provide a base frame for the mill that secures both mechanical and electrical parts including the mill housing to reduce manufacture and repair time.

4 Claims, 6 Drawing Sheets

GRINDING MILL

BACKGROUND OF THE INVENTION

Field of the Invention

A grinding mill that utilizes mill stones that minimize the mechanical devices required to regulate the mill stones. A grinding mill which allows a hopper to quickly and easily be removed. A grinding mill that utilizes a new base to secure the motor and electrical components for easier assembly.

Prior Art

The invention relates to a grinding mill. A grinding mill is the exposure of a mechanical force to a grain to overcome the interior bonding forces of the grain. The mechanical force causes the grain to break and pulverizes the grain into small pieces or into flour. Grinding food serves several purposes such as increasing the flavor, the texture, and nutritional value of the food.

The concept of grinding or milling food particles dates to prehistoric humans. Currently, there are several different types of grinding mills available. One very popular method of grinding utilizes mill stones. Grain or other food is placed between the two milling heads. As the mill stones rotate, the grain is shredded into smaller particles. In some applications, only one mill stone is rotating while the other mill stone remains stationary.

Grinding mills that utilize mill stones have several limitations. To control the texture and size of the final grain or flour, the user must control the compression force between the mill stones. If the compression force between the mill stones is too weak, the mill stones will not apply enough force to the grain and will not achieve the desired final product. However, if the compression force between the mill stones is too great, the mill stones will be destroyed or wear prematurely. In addition, the milling heads may create excess noise and vibration. Therefore, the user must control the compression force between the mill stones.

Another limitation is that mill stones require frequent cleaning. The majority of mill stones are located in the center of the mill. Traditionally, it takes several mechanical steps to gain access to the mill stones.

Yet another limitation is the cost of manufacturing mills. Grinding mills have several mechanical and electrical parts. Generally, these parts are enclosed in the mill housing. Because users prefer the smallest mill, the size of the mill housing is diminutive. Historically, each part is placed individually inside the mill housing. Because of the limited space, excess time is required to carefully place each part. If the mill needs to be repaired, the user is required to move each part individually and then replace each part.

Several prior attempts strived to solve these limitations. These prior attempts generally required excessive mechanical parts which increased the cost of production and increased the failure rate of the mills.

Although the prior art did attempt to minimize the described limitations, the prior art did not resolve the limitation adequately. In spite of the previous efforts, there remains a need for a grinding mill to improve the grinding process and provide an easy way for the user to control the milling heads. There is a need to create a grinding mill that allows the user to quickly and easily gain access to the milling heads which is also easy to assemble and to repair.

SUMMARY OF THE INVENTION

It is a principal object of the invention to provide a mill that utilizes mill stones that improve the grinding process while minimizing the mechanical processes of regulating the mill stones. Another object of the invention is to allow a user to gain quick and easy access to the mill stones. Still another object is to provide a mill which is easy to manufacture and repair by providing a base which secures both electrical and mechanical parts.

DESCRIPTION OF THE DRAWINGS

The invention may take form in certain parts and arrangement of parts, and preferred embodiment of which will be described in detail in the specification and illustrated in the accompany drawing, which for a part hereof.

DRAWING—REFERENCE NUMBERS

Figure 1:
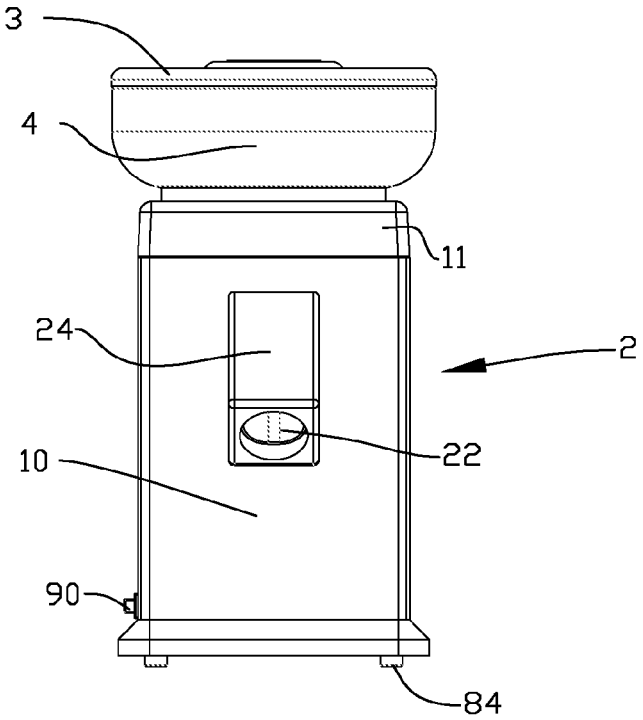
FIG. 1 shows a front side plan view with the hopper attached to the mill.

| | |
|---|---|
| 2 | grinding mill |
| 3 | hopper lid |
| 4 | hopper |
| 5 | hopper base |
| 6 | mill assembly |
| 8 | motor |
| 10 | housing |
| 11 | housing cover |
| 12 | base frame |
| 14 | lower mill stone |
| 16 | upper mill stone |
| 18 | drive shaft |
| 20 | collection container |
| 22 | spout |
| 24 | chute |
| 25 | angle |
| 26 | container flange |
| 27 | collection bowl rim |
| 28 | stator slot |
| 29 | stator |
| 30 | mill stone assembly opening |
| 32 | Upper stone backer |
| 34 | Upper stone backer slot |
| 36 | Upper stone backer rim |
| 51 | knob |
| 52 | mill stone controller assembly |

-continued

| | |
|---|---|
| 53 | controller piston |
| 55 | piston opening |
| 56 | controller base |
| 57 | external screw thread |
| 59 | internal screw threads |
| 60 | controller shaft |
| 61 | lever |
| 62 | notched wheel |
| 80 | electrical components |
| 82 | inlet ports |
| 84 | feet |
| 86 | fan |
| 88 | motor supports |
| 89 | damper |
| 90 | electrical switch |
| 94 | fan chamber walls |
| 95 | base plate |
| 96 | fan chamber |
| 97 | cord relief |
| 98 | electrical fastener |
| 100 | housing mount |
| 140 | restrictive opening |
| 142 | detent plunger |
| 144 | detent connector |
| 146 | detent channel wedge |
| 148 | detent shaft |
| 150 | detent entrance |
| 152 | channel |

DETAILED DESCRIPTION OF THE PREFERRED EMBODIMENTS

The following discussion describes embodiments of the invention and several variations of these embodiments. This discussion should not be construed, however, as limiting the invention to these particular embodiments. Practitioners skilled in the art will recognized numerous other embodiments as well. It is not necessary that the mill have all the features described below with regard to the specific embodiment of the invention shown in the figures.

In the following description of the invention, certain terminology is used for the purpose of reference only, and is not intended to be limiting. Terms such as "upper", "lower", "above", and "below," refer to directions in the drawings to which reference is made. Terms such as "inwards" and "outward" refer to directions towards and away from, respectively, the geometric center of the component described. Terms such as "side", "top", "bottom," "horizontal," and "vertical," describe the orientation of portions of the component within a consistent but arbitrary frame of reference which is made clear by reference to the text and the associated drawings describing the component under discussion. Such terminology includes words specifically mentioned above, derivatives thereof, and words of similar import.

Referring generally to FIG. 1, a grinding mill 2 embodying features of the present invention comprise a hopper 4, a mill assembly 6, a motor 8, a housing 10 and a base frame 12. The motor 8 may be any type of motor known in the industry, such as an electric AC motor. The housing 10 covers the mill assembly 6 and the motor 8. Located at the top of the housing 10 is a housing cover 11. The housing cover 11 has an opening to accommodate the attachment of the hopper 4 to the mill 2. In addition, the housing cover 11 has several air ports (not shown) to allow the movement of air through the housing 10. The motor 8 attaches to the housing cover 11. The housing 10 and housing cover 11 may be made of any ridge material such as wood, plastic, stone or steel. However, the housing 10 and housing cover 11 are not required to be the same material.

The hopper 4 extends above the housing 10. The hopper 4 stores and directs grain (not shown) into the mill assembly 6. The hopper 4 includes a removable hopper lid 3. Located at the bottom of the hopper 4 is a hopper base 5. The hopper 4 may be made of any ridged or semi-ridged material such as wood, rubber, plastic or steel.

Figure 3:
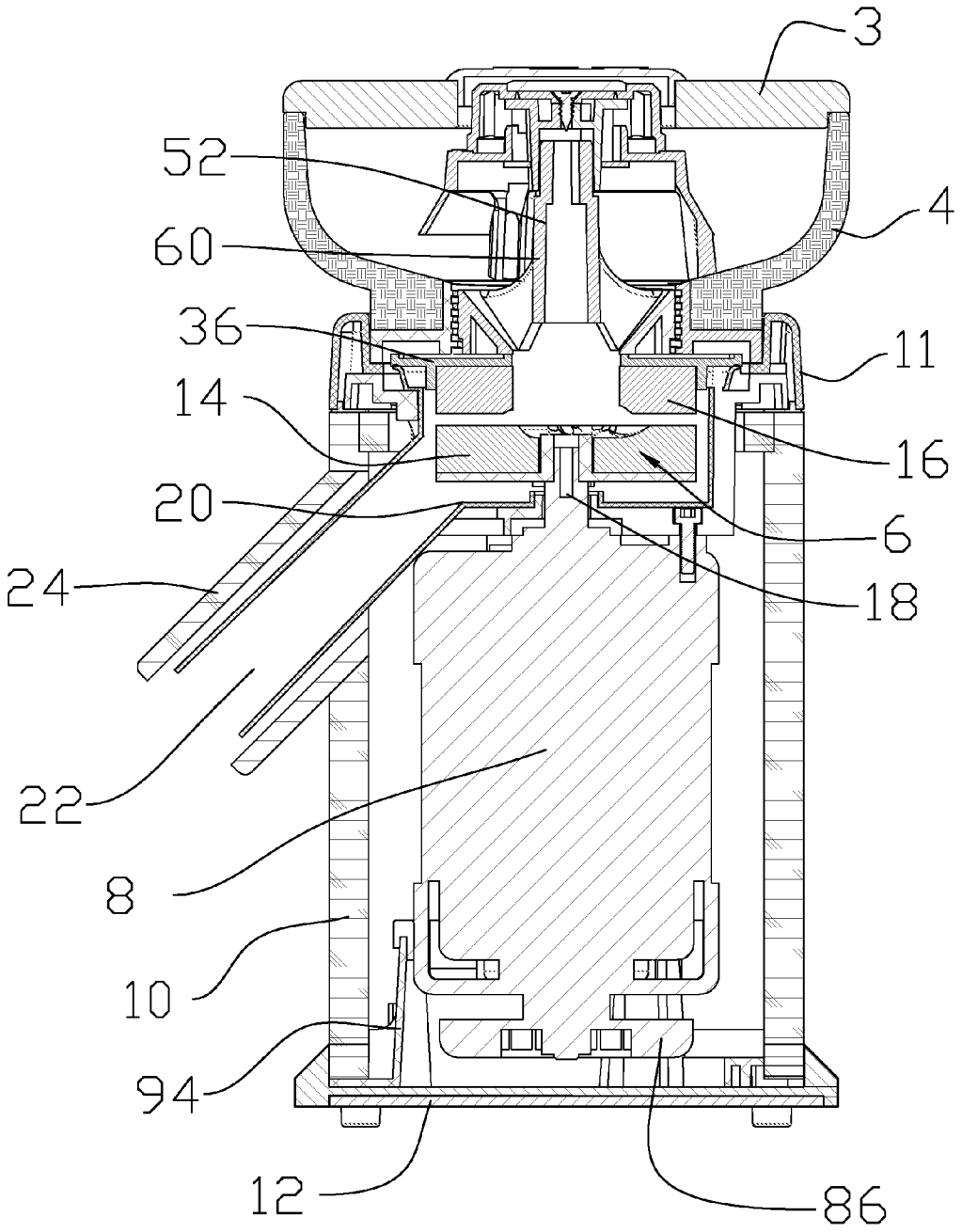
FIG. 3 shows a profile sectional view, with the hopper attached with the hopper lid.

As shown in FIG. 3, the mill assembly 6 has a lower mill stone 14, an upper mill stone 16, and a collection container 20. The mill stones are made of any material suitable for grinding food particles. The lower mill stone 14 is connected to the motor 8 by a drive shaft 18. The drive shaft 18 transfers the rotational movement of the motor 8 to the lower mill stone 14.

The upper mill stone 16 is permanently connected to an upper stone backer 32. The upper stone backer 32 has a greater diameter than the upper mill stone 16 that creates a upper stone backer rim 36. The upper stone backer 32 is made of any ridged material such as plastic. The center of the upper mill stone 16 and the upper stone backer 32 have mill stone assembly opening 30 which allows for the flow of grain through the mill 2. In operation, the collection container 20, the upper mill stone 16, and upper stone backer 32 remain stationary. Located near the outer circumference edges of the collection container 20 and the upper stone backer rim 36 are several stator slots 28. Connected to the housing 10 are several stators 29. The stators 29 and the stator slots 28 prevent the movement of the upper stone backer 32, the upper mill stone 16, and collection container 20. However, along the longitudinal axis of the upper mill stone 16 and the upper stone backer 32 are allow to move freely or float in the collection container 20.

The upper mill stone 16 and the lower mill stone 14 are both surrounded by the collection container 20. Grain feeds into the mill assembly 6 from the hopper 4 through the mill stone assembly opening 30. The grain travels between the upper mill stone 16 and the lower mill stone 14 where it is pulverized into a smaller size or flour. The distance or gap between the upper mill stone 16 and lower mill stone 14 determines the final size of the grain or flour exiting the mill 2.

The pulverized grain or flour discharges from the upper mill stone 16 and the lower mill stone 14 and is gathered in the collection container 20. The pulverized grain or flour exits the mill assembly 6 through a spout 22 located on the outer circumference of the collection container 20. Generally, the collection container 20 and the spout 22 will be made of the same material. The spout 22 exits the housing 10 through a chute 24 located on the side of the housing 10. The chute 24 is generally made of the same material as the housing 10, but not required.

Figure 7:
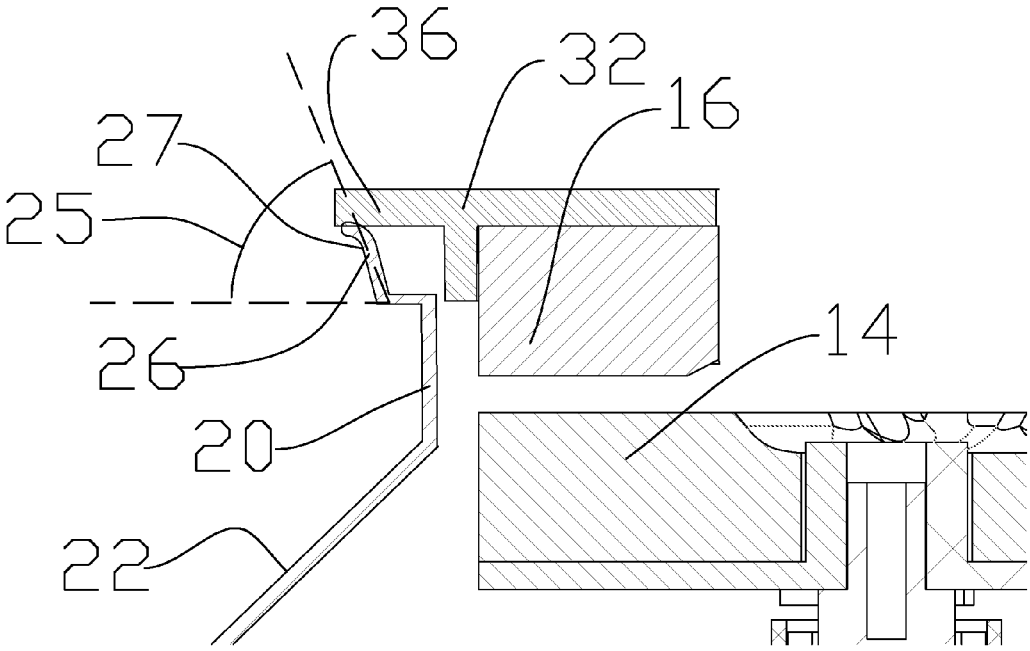
FIG. 7 shows a cross section and the relationship of the collection container, the upper mill stone, the Upper stone backer, the Upper stone backer rim, the collection rim, and container flange.
Figure 8:
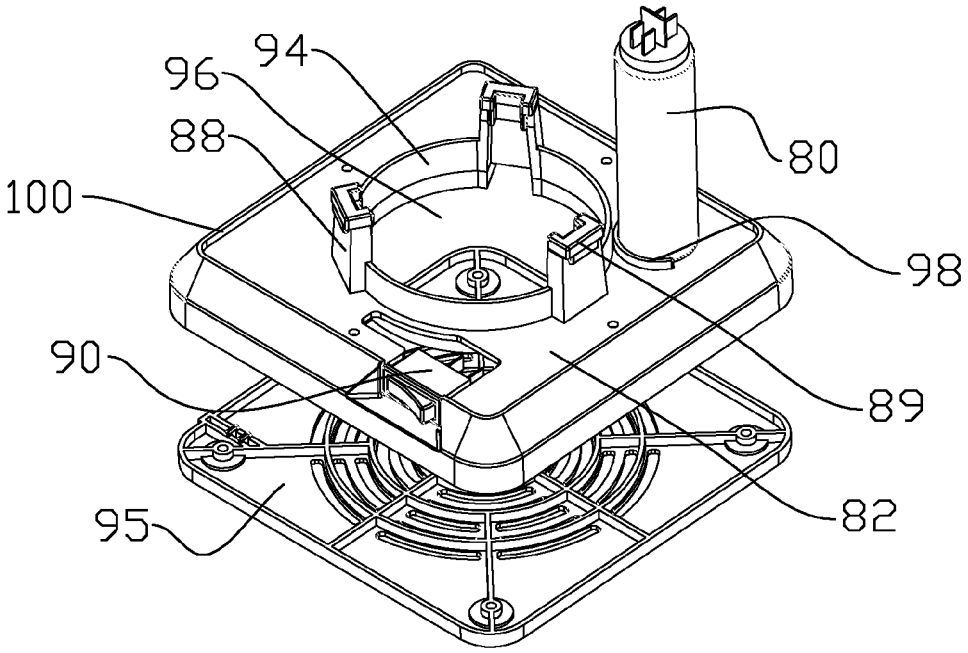
FIG. 8 shows an exploded side view of the base frame and base plat, with an electrical component attached to the base frame illustrating that the electrical component can be attached to the frame independently of any other devices.
Figure 9:
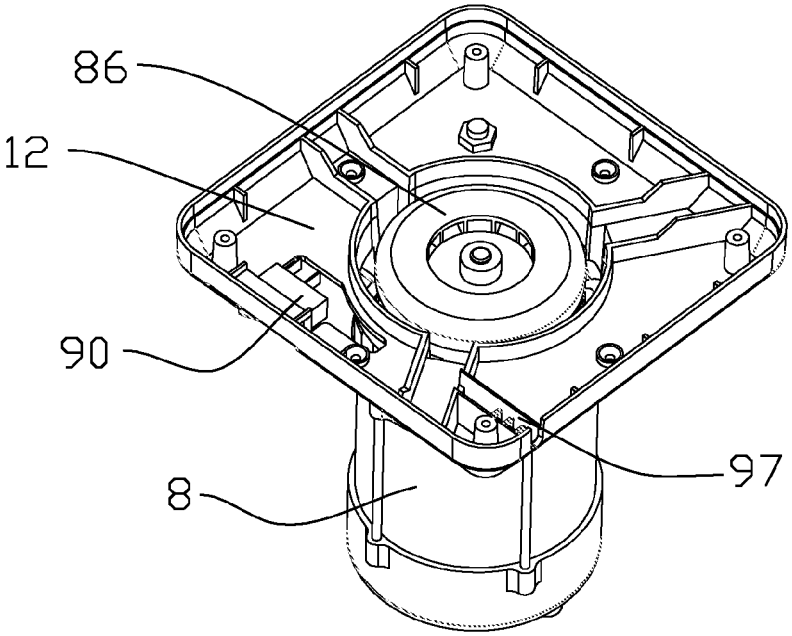
FIG. 9 shows a bottom view of the base frame with the base plat removed and a motor attached to the base frame.
Figure 10:
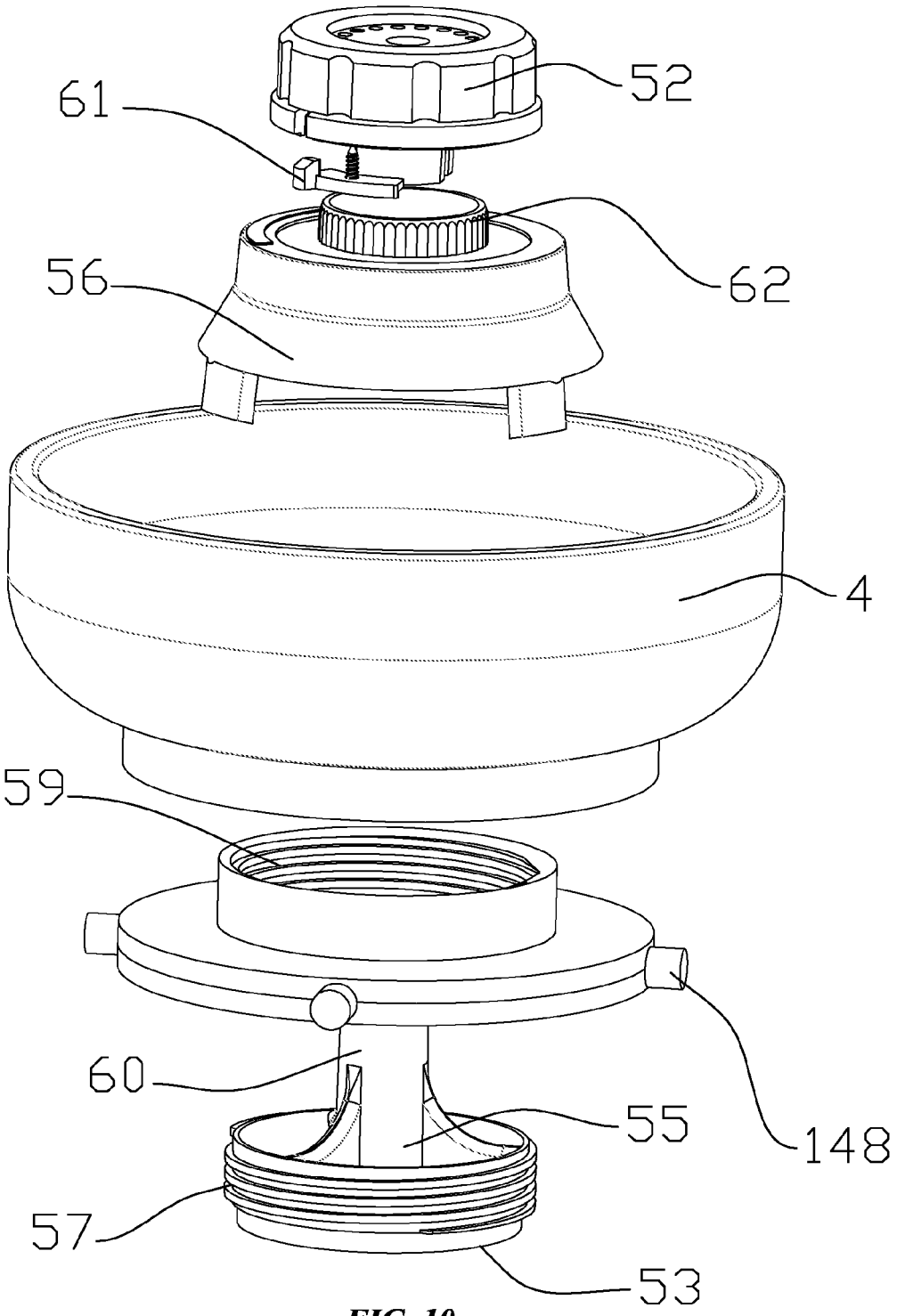
FIG. 10 shows an exploded view of the hopper and mill stone controller assembly.

As shown in FIG. 7, located at the top circumference of the collection container 20 is a collection bowl rim 27. The upper stone backer rim 36 rests on the collection bowl rim 27. The union between the collection bowl rim 27 and upper stone backer rim 36 creates a seal between the collection container 20 and the upper stone backer 32. The seal prevents debris or dust particles from leaving the mill assembly 6. The collection bowl rim 27 is made of any any resilient material such as elastomer. However, any material would work such that when a force is applied to the material, the material will resist the force but still deform. When the force is removed, the material will return to its normal shape.

In addition to creating a seal, the upper stone backer rim 36 assists in controlling the distance or gap between the upper mill stone 16 and lower mill stone 14. When a downward force is applied to the upper stone backer 32, the force is transferred to the upper stone backer rim 36 and then to collection bowl rim 27. Because the collection bowl rim 27 is made from a resilient material, such that it resists any change but will deform to the force. When the collection bowl rim 27 deforms, the distance or gap between the upper mill stone 16 and lower mill stone 14 decreases. When the downward force is removed, the collection bowl rim 27 returns to its normal shape, pushing the upper mill stone 16 up. This increases the gap between the lower mill stone 14 and upper mill stone 16.

As shown in FIG. 7, the collection bowl rim 27 may have a container flange 26. The container flange 26 allows greater flexibility to the collection bowl rim 27. The container flange 26 has an angle 25 from the perpendicular plain of the longitudinal axis of the collection container 20 and housing 10 between 1 to 85 degrees. In practice, the preferred angle 25 is 80 degrees when no pressure is applied to the collection bowl rim 27.

When the downward force is applied to the collection bowl rim 27, the angle 25 decreases. When the downward force is removed, the angle 25 will return to return to its original degree. This pushes the upper stone backer rim 36 upwards and the distance between the lower mill stone 14 and upper mill stone 16 increases.

Figure 2:
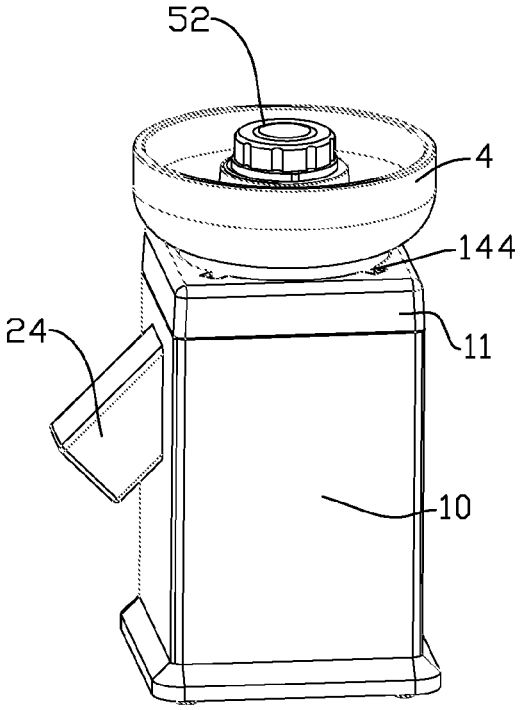
FIG. 2 shows a side view with the hopper attached to the mill with the hopper lid removed to showing the mill stone controller assembly.
Figure 5:
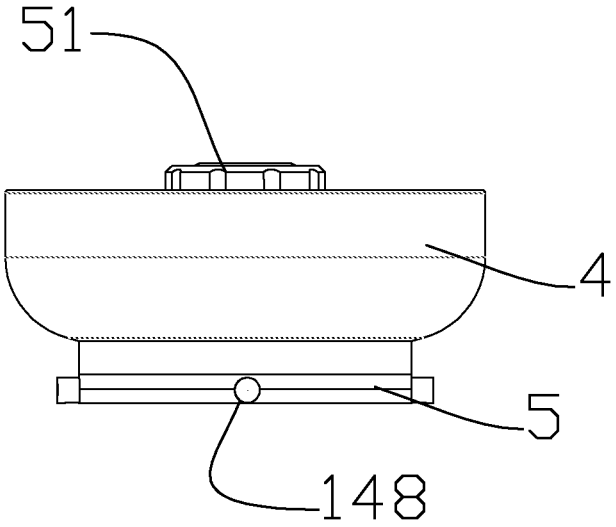
FIG. 5 shows a side view of the hopper with the hopper lid removed.
Figure 6:
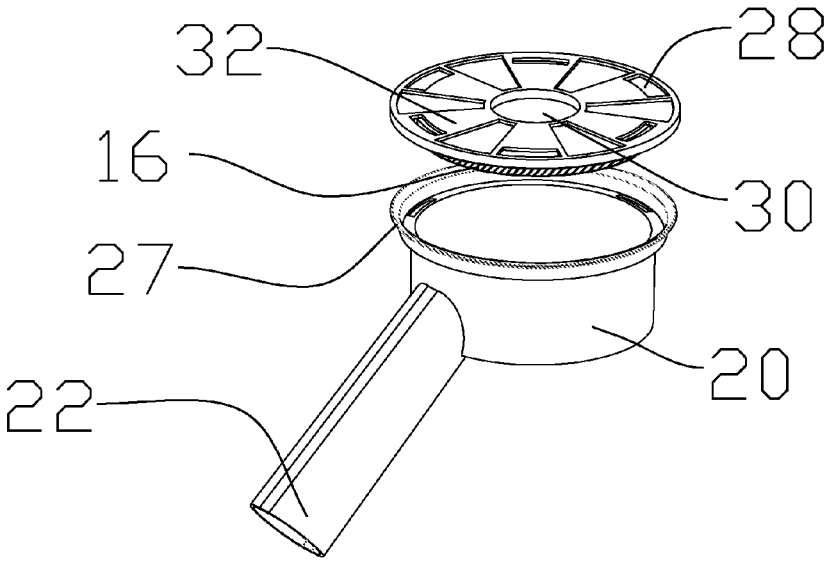
FIG. 6 shows an exploded view of the collection container and the upper mill stone with the Upper stone backer attached to the upper mill stone.

As illustrated in FIG. 2, enclosed in the hopper 4 is a mill stone controller assembly 52. As shown in FIG. 1, when the hopper lid 3 is on the hopper 4, the mill stone controller assembly 52 is hidden. The mill stone controller assembly 52 allows the user to adjust the compressive force that is applied by the upper mill stone 16. As shown in FIG. 5, a controller base 56 attaches the mill stone controller assembly 52 to the hopper 4.

The mill stone controller assembly 52 includes a knob 51, a controller shaft 60, and a piston 53. Located at the top of the mill stone controller assembly 52 is the knob 51. The controller shaft 60 connects the piston 53. The knob 51 communicates with the controller shaft 60. To allow grain to flow through the piston 53, there are several piston openings 55. The mill stone controller assembly 52 may be made of any ridged material.

Located on the outer perimeter of the piston 53 is an external screw thread 57. An associated internal screw thread 59 is located on the hopper base 5. When the user applies a rotational force to the knob 51, the rotational force is transferred to the piston 53 by the controller shaft 60. When a rotational force is applied to the piston 53, the external screw thread 57 and internal screw threads 59 convert the rotational force to a linear movement of the piston 53. The piston 53 communicates the linear movement against the upper stone backer 32. As described above, when a downward force is applied to the upper mill stone 16, the compressive force between the upper mill stone 16 and lower mill stone 14 increases. The mill stone controller assembly 52 is generally made of any ridge material such as plastic or steel.

To regulate the movement of the mill stone controller assembly 52, a notched wheel 62 and a spring-loaded lever 61 are located near the knob 51. The spring-loaded lever 61 applies a force against the notched wheel 62 which restrains the movement of the mill stone controller assembly 52 such that a deliberate force applied by the user is required to initiate the movement of the knob 51 and the piston 53.

Figure 4:
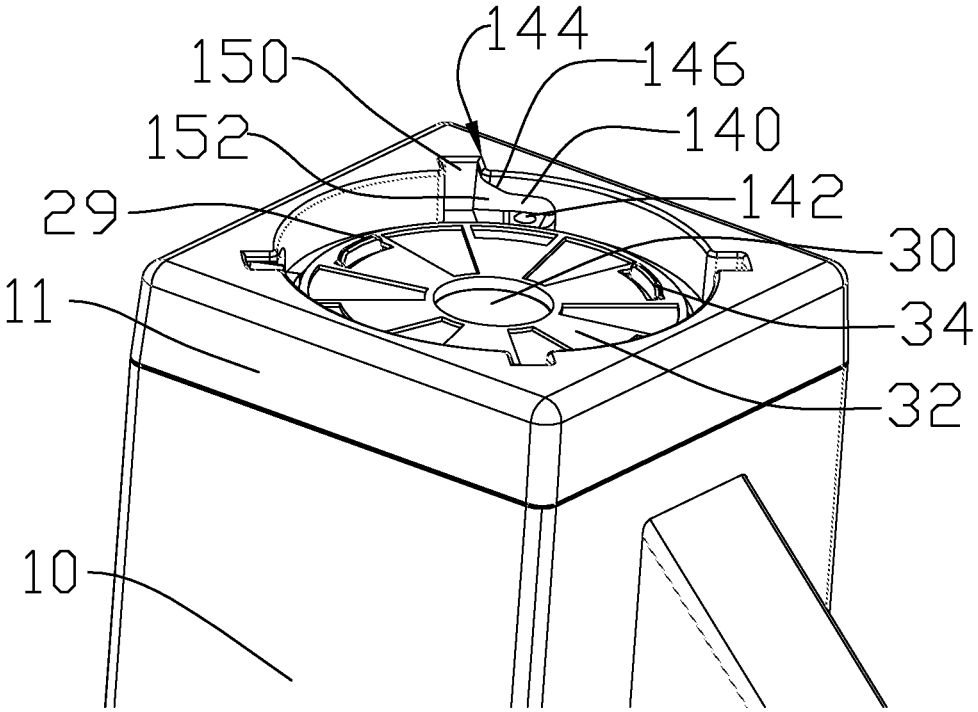
FIG. 4 shows a top view; with the hopper remove showing the top view of the mill assembly.

As seen in FIG. 4 the hopper 4 is connected to the mill 2 by a detent connection 144. The detent connection 144 allows for the hopper 4 to be quickly and releasably connected to the mill 2. The detent connection 144 has a detent entrance 150 and a channel 152. Located at the front of the channel 152 is a channel wedge 146. Near the end of the channel 152, the width of the channel 152 is reduced, thus creating a restrictive opening 140. The length of the channel 152 is between 0.5 cm and 10 cm.

As shown in FIG. 5, located at the base of the hopper 4 is a detent shaft 148. The diameter of the detent shaft 148 is smaller than the width of the channel 152, but larger than the width of the restrictive opening 140. The location and the number of detent connections 144 correspond to the number of detent shafts 148 located on the hopper 4.

The user places the detent shaft 148 into the detent entrance 150. When the hopper 4 is rotated around its longitudinal axis, the detent shaft 148 moves along the channel 152. The movement of the detent shaft 148 is aided by the channel wedge 146. A deliberate force applied by the user is required to move the detent shaft 148 past the restrictive opening 140. When the detent shaft 148 is moved to the end of the channel 152, the hopper 4 is securely but releasably attached to the housing 10.

In another presently preferred aspect, the restrictive opening 140 contains a detent plunger 142. When a force is applied to the detent plunger 142, it will deform or move and increase the width of the restrictive opening 140. In another presently preferred aspect, the detent shaft 148 is made of a material that deforms when it travels through the restrictive opening 140, but returns to its original shape after passing past the restrictive opening 140.

For the user to gain access to the mill assembly 6, the user will now only be required to rotate the hopper 4 less than 10 cm, while the detent connection 144 will ensure the hopper 4 is connected to the mill 2 during operation. In addition, removing the hopper 4 does not require the handling of the mill stone controller assembly 52. When the hopper 4 is reattached, the mill stone controller assembly 52 setting remains the same. This allows the user to keep the consistence of the output of the grain from the mill 2.

The base frame 12 is located at the bottom of the mill 2. The base frame 12 may be any appropriate shape, size, or configuration, such as generally rectangular or square. However, the base frame 12 must have the same shape as the housing 10. The base frame 12 may be made of any appropriate material such as plastic, aluminum, steel or any ridged material.

The base frame 12 may include one or more feet 84. The feet 84 engage a surface (not shown) that supports and stabilizes the mill 2. The feet 84 are generally made of any material that prevents the movement of the mill 2 and minimizes the noise and vibration of the mill 2.

The base frame 12 includes at least one motor support 88. The motor support 88 attaches the motor 8 to the base frame 12. The motor support 88 may be located at any appropriate position such is required to securely attach the motor 8 to the base frame 12. In practice, there will be more than one motor support 88. To minimize the noise and vibration of the motor 8, a damper 89 may be placed between the motor 8 and the motor supports 88. The damper 89 may be made of any material which absorbs vibrations yet sturdy enough to secure the motor 8. The material of the motor support 88 is any ridged material. However, the motor support 88 will generally be of the same material as the base frame 12.

The base frame 12 may include an electrical fastener 98. The electrical fastener 98 may be located at any appropriate position such is required to securely attach an electrical component 80 or an electrical switch 90 to the base frame 12. The electrical switch 90 controls the flow of electricity to the motor 8. In practice, there will be multiple electrical fasteners 98 located on the base frame 12. The material of the electrical fastener 98 is any ridged material. However, the electrical fastener 98 will generally be of the same material as the base frame 12.

Located at the base of the motor 8 is a fan 86. The fan 86 creates air flow through the housing 10. The air flow is required to cool the internal components of the mill 2. The base frame 12 may include a fan chamber 96. The fan chamber 96 is comprised of at least one fan chamber wall 94. The fan chamber 96 generally has a cylindrical configuration similar to the fan 86. The fan chamber 96 facilitates the air flow through the mill 2 and to protect electrical components 80 near the base frame 12.

The base frame 12 includes a housing mount 100. The housing mount 100 creates a raised ridge located around the outer circumference of the base frame 12. The housing mount 100 attaches the housing 10 to the base frame 12. The housing mount 100 minimizes the machining and complexity of the housing 10. This allows for many different materials to be utilized for the housing 10 such as stone, steel, wood, porcelain or any ridged material.

Located on the bottom of the base frame 12 is a cord relief 97. The cord relief 97 secures the power cord (not shown) to the mill 2.

Located on the bottom of the base frame 12 is a base plate 95. The base plate 95 has the same shape or configuration that generally corresponds to the shape of the base frame 12. The base plate 95 may include at least one inlet port 82 to receive air flow through the housing 10. The number and size of the inlet port 82 is determined by the amount of air flow required. The air flow is necessary to cool the internal components of the mill 2.

The base plate 95 protects the user from the motor 8 and the fan 86. The feet 84 may be connected to the base frame 12. In the preferred aspect, the mechanical device that is securing the feet 84 to the base frame 12 will secure the base plate 95. The base plate 95 also secures the power cord.

In practice, base frame 12, electrical fastener 98, and motor support 88 are independent of the housing 10. When the mill 2 is manufactured, the electrical components 80 will be securely fastened to the base frame 12 before the housing 10 is installed. This unique base frame 12 will reduce manufacturing times. Because the electrical components 80 are securely attached to the base frame 12 during the operation of the mill 2, the chance of these items moving and becoming damaged is greatly reduced.

A variety of different permutations of the invention is contemplated, and not meant to be limited by this disclosure. The present invention is not limited to the preferred embodiments described in this section. The embodiments are merely exemplary, and one skilled in the art will recognize that many others are possible in accordance with this invention. Having now generally described the invention, the same will be more readily understood through references to the above descriptions and drawings, which are provided by way of illustration, and are not intended to be limiting of the present invention, unless so specified.

Having thus described the invention, it should be apparent that numerous modifications and adaptations may be resorted to without departing from the scope and fair meaning of the instant invention as set forth herein above and as described herein below by the claims.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings can be replaced by alternative features serving the same, equivalent, or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" or "step" clause as specified in 35 U.S.C. §112.

The above description in the "Background" section is to provide a summary of information relevant to the present invention and is not a concession that any of the information provided or publications referenced herein is prior art to the presently claimed invention.

What is claimed:

1. A grinding device for food comprising:

(a) a mill having a housing, a motor, a hopper, and a mill assembly;

(b) the mill assembly comprising a collection container, a lower mill stone, and an upper mill stone; wherein the lower mill stone and upper mill stone are located in the collection container;

(c) the collection container having a collection bowl rim;

(d) the upper mill stone is attached to an upper stone backer, wherein the upper stone backer interacts with the collection bowl rim;

(e) the collection bowl rim is made of a resilient material;

whereby, the collection bowl rim assists to position the upper mill stone in the collection container.

2. The device as recited in claim 1, wherein said collection container, and said collection bowl rim are composed of elastomer.

3. The device as recited in claim 1, wherein said collection bowl rim having a container flange;

wherein, the container flange has an angle from the perpendicular plain of the longitudinal axis of said mill assembly between 5 to 85 degrees.

4. A method for regulating mill stones in a grinding device for food comprising the following steps:

(a) providing a mill comprising;

(i) a housing, a hopper, a motor, and a mill assembly;

(ii) the mill assembly comprising a collection container; a lower mill stone, and an upper mill stone;

(iii) the collection container having a collection bowl rim;

(iv) the upper mill stone is attached to an upper stone backer, wherein the upper stone backer interacts with the collection bowl rim;

(v) the collection bowl rim is made of a resilient material;

wherein, the collection bowl rim assists to position the upper mill stone in the collection container;

(vi) a mill stone controller assembly having a knob, a controller shaft, and a piston;

(b) applying a rotational force to the knob causing the knob to rotate; the rotational movement is transferred to the piston by the controller shaft the piston converts the rotational movement into a linear movement of the piston; the piston communicates the linear movement to the upper mill stone; the upper mill stone communicates the linear movement to the collection rim; the collection bowl rim resists the movement.

* * * * *